US010716966B2

(12) United States Patent
Latronica et al.

(10) Patent No.: US 10,716,966 B2
(45) Date of Patent: Jul. 21, 2020

(54) PILATES EXERCISE SYSTEM AND METHOD OF USE

(71) Applicants: Miguel J. Latronica, Arlington, TX (US); Jeremy Latronica, Arlington, TX (US)

(72) Inventors: Miguel J. Latronica, Arlington, TX (US); Jeremy Latronica, Arlington, TX (US)

( * ) Notice: Subject to any disclaimer, the term of this patent is extended or adjusted under 35 U.S.C. 154(b) by 50 days.

(21) Appl. No.: 16/222,411

(22) Filed: Dec. 17, 2018

(65) Prior Publication Data

US 2019/0160325 A1 May 30, 2019

Related U.S. Application Data

(63) Continuation of application No. 15/809,331, filed on Nov. 10, 2017, now Pat. No. 10,556,146.

(Continued)

(51) Int. Cl.

| | |
|---|---|
| ***A63B 22/00*** | (2006.01) |
| ***A63B 21/00*** | (2006.01) |
| ***A63B 21/055*** | (2006.01) |
| ***A63B 22/20*** | (2006.01) |
| ***A63B 22/18*** | (2006.01) |

(Continued)

(52) U.S. Cl.

CPC ..... *A63B 22/0087* (2013.01); *A63B 21/0557* (2013.01); *A63B 21/4034* (2015.10); *A63B 21/4035* (2015.10); *A63B 21/4045* (2015.10); *A63B 21/4049* (2015.10); *A63B 22/0061* (2013.01); *A63B 22/18* (2013.01); *A63B 22/203* (2013.01); *A63B 23/0211* (2013.01); *A63B 21/008* (2013.01); *A63B 21/0442* (2013.01); *A63B 21/068* (2013.01); *A63B 21/0622* (2015.10); *A63B 69/0057* (2013.01); *A63B 2022/0038* (2013.01); *A63B 2022/185* (2013.01); *A63B 2225/09* (2013.01)

(58) Field of Classification Search

CPC ..... A63B 21/0428; A63B 21/02–055; A63B 21/4045; A63B 22/20–208; A63B 22/0087–0089

See application file for complete search history.

(56) References Cited

U.S. PATENT DOCUMENTS

2004/0176227 A1* 9/2004 Endelman ..... A63B 21/023 482/142
2005/0245367 A1* 11/2005 Horvath ..... A63B 21/068 482/93

(Continued)

*Primary Examiner* — Jennifer Robertson
(74) *Attorney, Agent, or Firm* — Eldredge Law Firm

(57) ABSTRACT

A pilates exercise system includes a pair of forward vertical members and a pair of rear vertical members extending upward from a base; a frame positioned at a top of the vertical members, the frame having one or more poles pivotally engaged with one or more framing members; the one or more poles to pivot from a horizontal to a vertical position; a platform assembly slidingly housed within the base, the platform assembly is to slide on a first track and a second track, the platform assembly, having a lower section to engage with the first track and the second track; a middle section slidingly engaged with the lower section; and an upper section pivotally attached to the middle section; and attachment elements secured to the vertical members and to provide locations for attachment of exercise equipment.

9 Claims, 16 Drawing Sheets

Related U.S. Application Data

(60) Provisional application No. 62/424,291, filed on Nov. 18, 2016.

(51) Int. Cl.

| | |
|---|---|
| ***A63B 23/02*** | (2006.01) |
| ***A63B 21/04*** | (2006.01) |
| ***A63B 21/008*** | (2006.01) |
| ***A63B 69/00*** | (2006.01) |
| ***A63B 21/068*** | (2006.01) |
| ***A63B 21/062*** | (2006.01) |

(56) References Cited

U.S. PATENT DOCUMENTS

| | | | | |
|---|---|---|---|---|
| 2010/0323857 | A1* | 12/2010 | D'Silva | A63B 21/154 482/121 |
| 2012/0283079 | A1* | 11/2012 | Solow | A63B 21/0552 482/142 |
| 2014/0100089 | A1* | 4/2014 | Kermath | A63B 21/023 482/133 |
| 2016/0213971 | A1* | 7/2016 | Jones | A63B 22/0061 |

* cited by examiner

PILATES EXERCISE SYSTEM AND METHOD OF USE

BACKGROUND

1. Field of the Invention

The present invention relates generally to a device that can be used for exercise, or for attachment atop an existing exercise device. More specifically, the present invention enables users to perform Pilates-style exercises, and enables users to add rotating and sliding functionality to existing Pilates machines.

2. Description of Related Art

Motion and movement are integral parts of maintaining proper health. To this end, a variety of exercise machines have been developed to aid in accessing and utilizing the various muscle groups of the body, for example, see device 101 configured for use with a user 103. The device 101 includes a plurality of elastic straps 105, 107 having loops 109, 111 at one end and secured to a rod 113 at an opposing end. In most scenarios, the device 101 is an effective means to stretching and achieving various Pilates exercises.

It should be understood that full body resistance exercises, such as those emphasized by Pilates-style workouts, are a popular solution to the general need for muscular stimulation, as they enable users to improve general strength, flexibility, and balance, and are widely believed to address lower back pain and provide other therapeutic effects when performed properly. Machines have been developed to support these exercises. Although device 101 and similar machines are adapted to assist the user with Pilates exercises many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
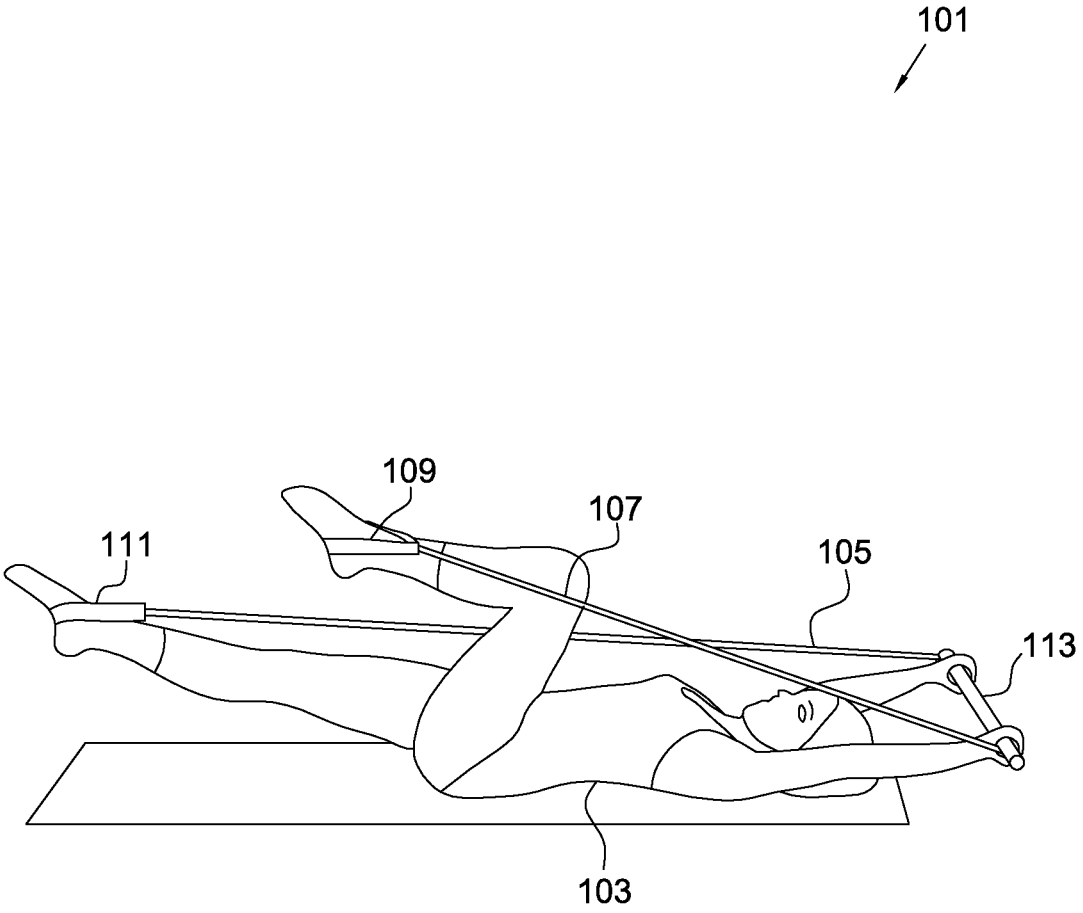
FIG. 1 (PRIOR ART)
FIG. 1 is a simplified schematic of a conventional process of ordering good online for home delivery.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems and methods for Pilates style exercises. The Pilates Exercise Machine disclosed herein provides a variety of means for adjusting resistance angles. The present invention utilizes a unique pair of sliding surfaces that rotate either independently or together to provide various muscle-engagement depending on user desire. The angle of the sliding surfaces relative to the floor may also adjust to vary the functional pattern of the exercise. Further, the present invention allows for adaptation atop an existing Pilates machine, thus increasing the functionality available to the user. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 2A-6 depict various views of a Pilates system 201 and method of use in accordance with a preferred embodiment of the present application. It will be appreciated that system 201 overcomes one or more of the above-listed problems commonly associated with the conventional systems and methods for assisting in Pilates exercises.

The present invention is a Pilates exercise system 201 that facilitates convenient body positioning for exercise. The present invention further allows for adaptation of an existing exercise equipment to augment overall functionality as an accessory, or may be utilized as a standalone exercise machine.

Figure 2A:
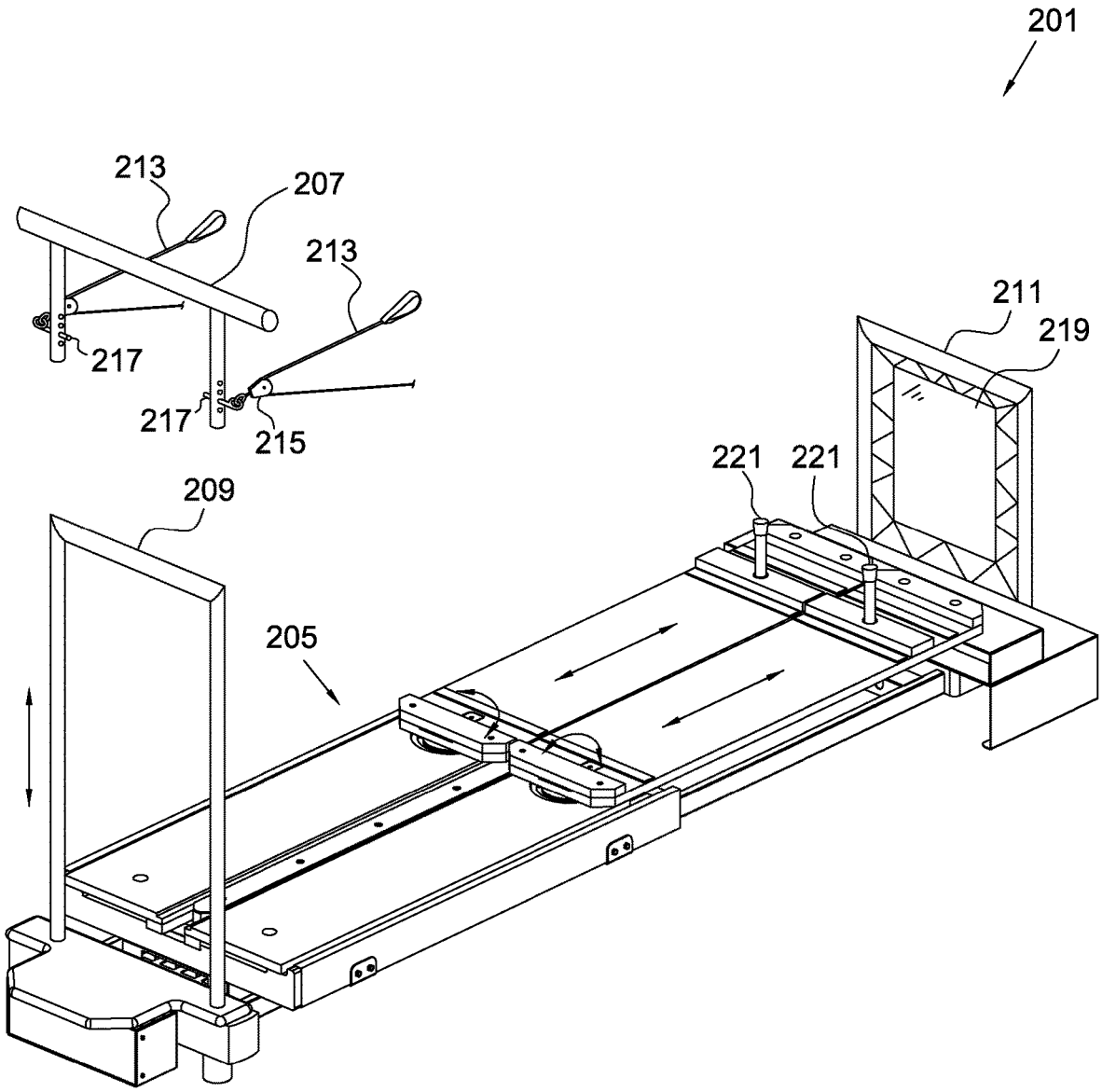
FIGS. 2A, 2B, 2C, and 2D are oblique views of a system of the present invention in accordance with the preferred embodiment of the present invention.

Referring specifically to FIG. 2A, the system 201 includes one or more of a plurality of seat cushions 327, 329, a frame 503 having a sliding surface, a plurality of tracks, a lower plurality of elastic bands 511, vertical grips 207, and a tower 209 that could be secured to a front portion of the frame via a plurality of holes. The cushion is any of a variety of removable soft pads that provides comfort to the user during use.

Figure 2B:
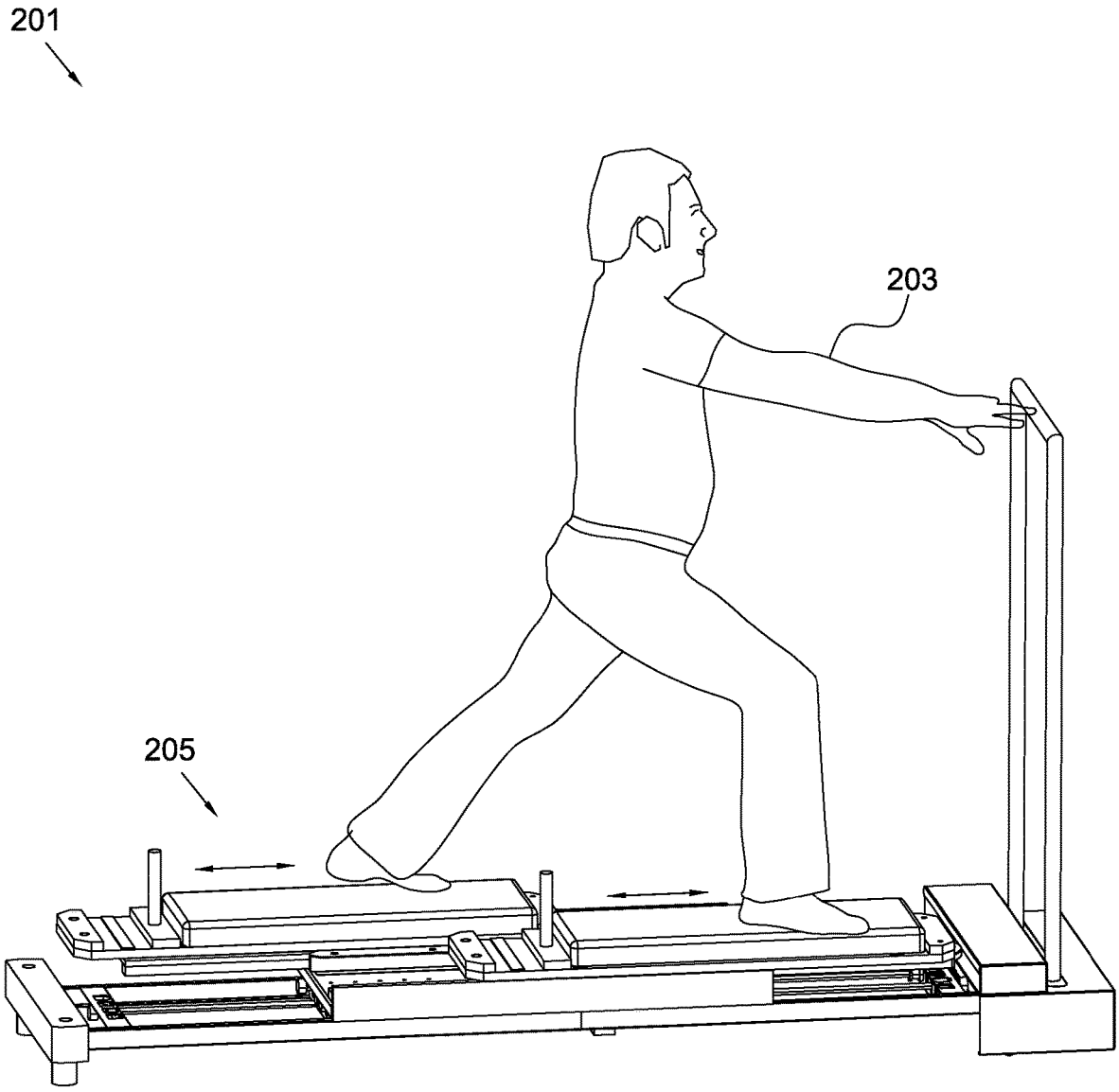
Figure 2C:
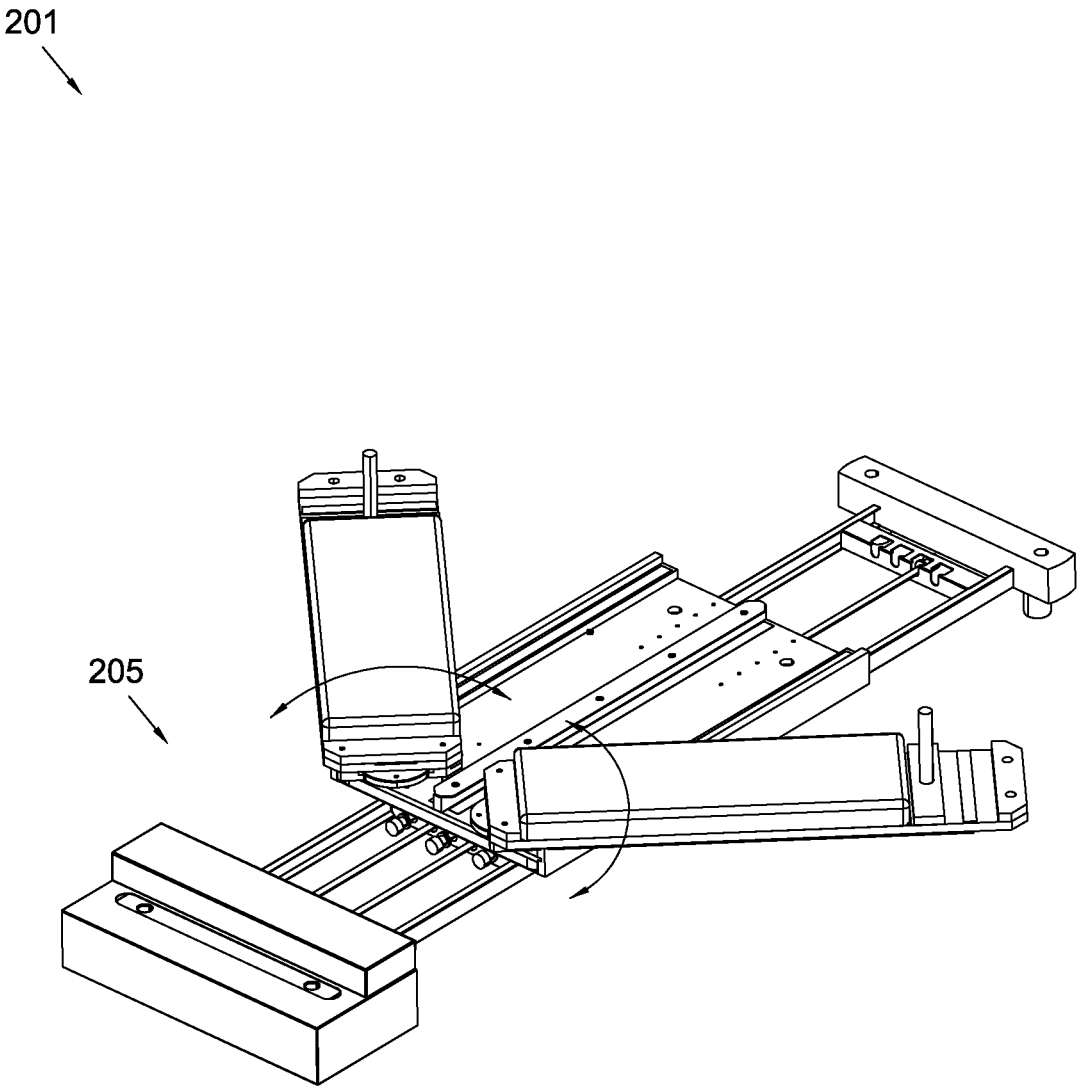
Figure 2D:
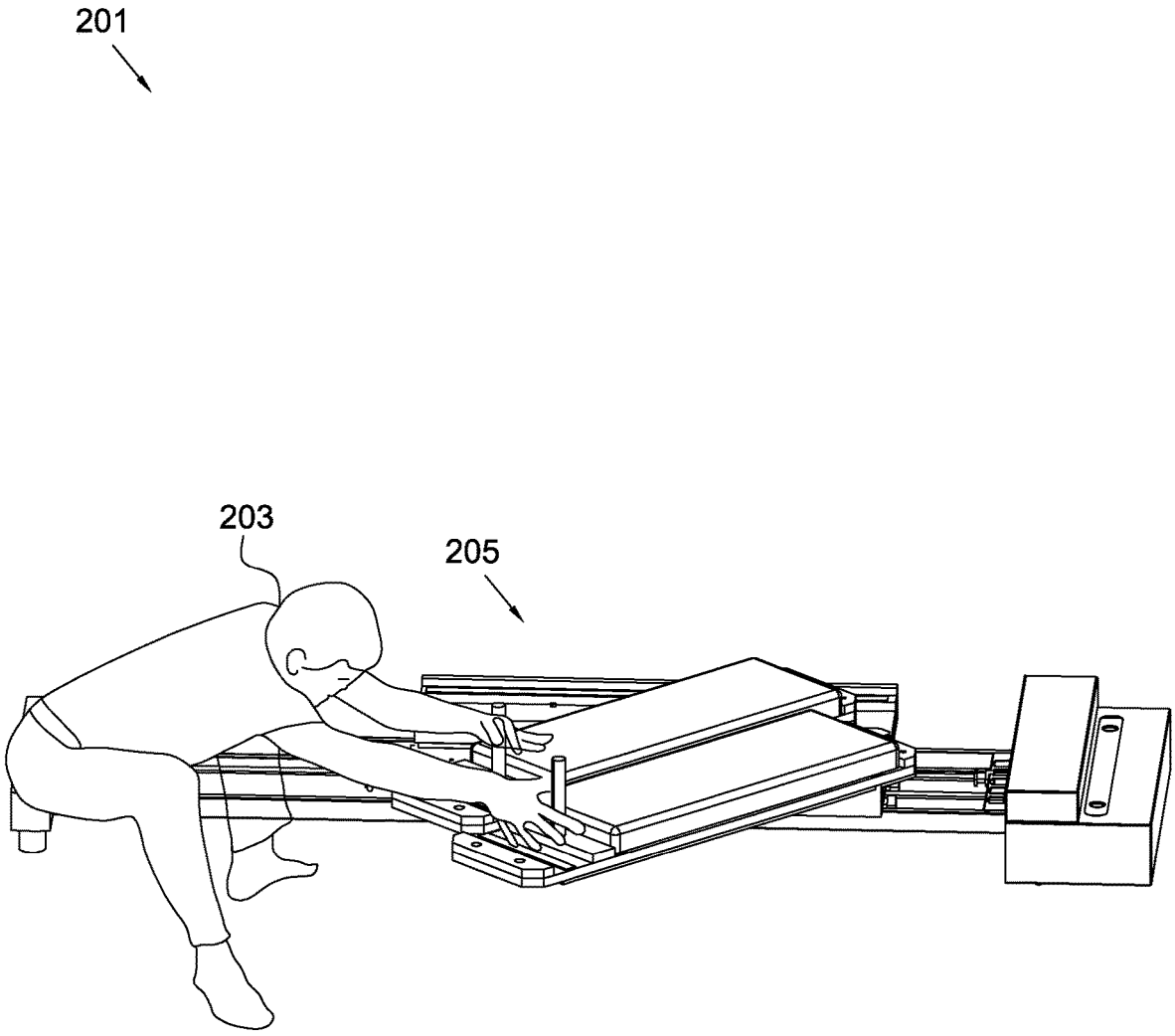
Figure 2E:
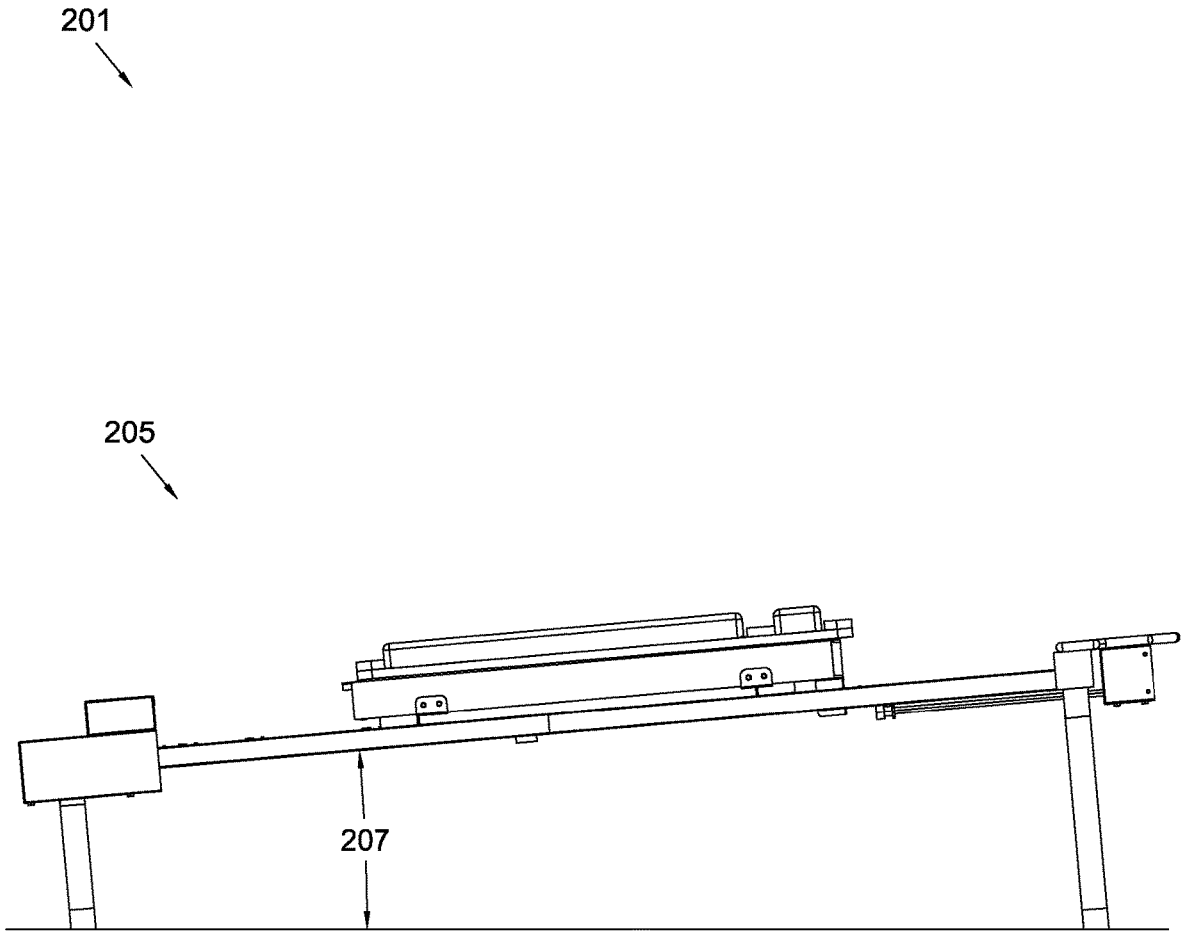
FIG. 2E is a side view of the system of FIG. 2A.

The vertical grip is a surface generally opposite the seat that connects the lower plurality of elastic bands to the sliding surface. The vertical grip, as seen in FIG. 2A, comprises of a handlebar, a plurality of support holders, and a plurality of tightening fasteners. It will be appreciated that the sliding surface of the assembly facilitates use of the lower plurality of elastic bands and the middle plurality of elastic bands as shown in FIG. 2B.

The plurality of support holders is a set of generally tubular extrusions extending from the vertical grip that enables removable attachment of the handlebar. The plurality of tightening fasteners is a set of removable fasteners that enables modularity of the handlebar. In the preferred embodiment, the plurality of tightening fasteners utilizes a threaded extrusion in order to tighten and loosen pressure on the handlebar; however, there are alternative arrangements which utilize friction fits, adhesives, collets, ferrules, and a variety of other means to secure the handlebar removably to the vertical grip, and the preferred embodiment is not meant to be limiting.

In the contemplated embodiment, the handlebar provides a user with the ability to balance or grasp for added balance during use, and comprises a plurality of supports and a beam. The plurality of supports is a set of preferably cylindrical extrusions that enable support of the handlebar from the vertical grip. The beam is an extrusion that facilitates balance by, in the preferred usage of the present invention, allowing a user to grasp high during exercise. The beam connects the plurality of supports.

It will be appreciated that a plurality of devices 207, 209, and 211 could be removably secured to the frame to achieve desired Pilate positions along with facilitating physical exercises. For example, a kickstand that extends relatively perpendicular to the frame and has a surface 219 that the feet of the user can rest thereupon. Further, it is contemplated having a handle bar 207 configured to engage with the holes towards the front section of the frame that removably attaches with the plurality of holes and engages with pins 217 and pulleys 215, which in turn engage with straps 213 that in turn fasten to the moveable platform section. Accordingly, this device allows the user to slide the platform relative to the frame as indicated by a plurality of arrows. In FIG. 2A, it is also shown that the upper section of the platform are configured to rotate relative to the middle section of the platform assembly. The two pins 221 are configured to retain the upper section in a locked position so as to prevent rotation.

In FIG. 2B, the user 203 is able to slide the upper section of the platform assembly 205 along the track formed of the middle section, as shown with a plurality of arrows. In comparison to FIG. 2A, the added devices are removed to illustrate that one or more devices can be added to the present machine for different stances and/or exercises.

Figure 3:
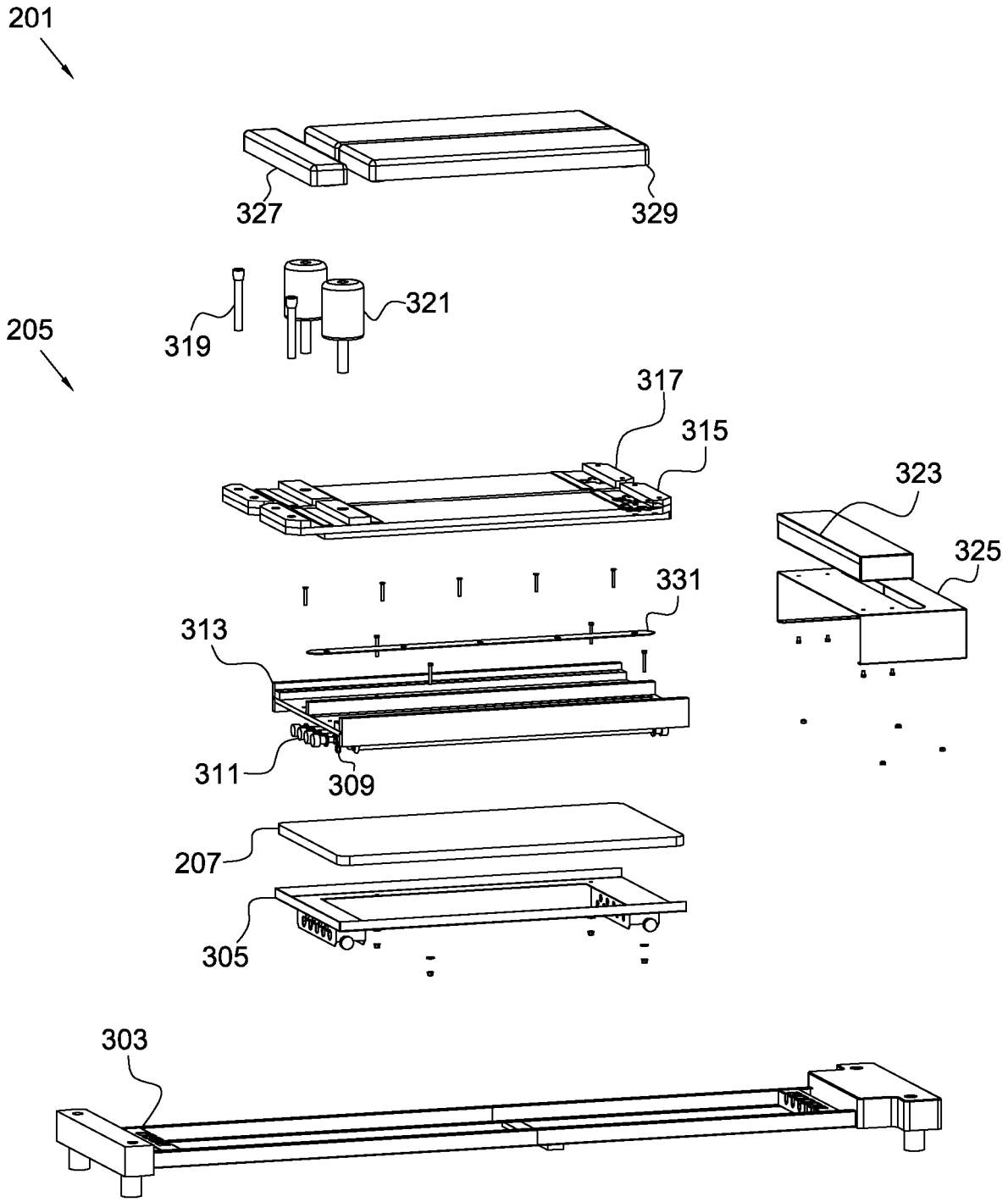
FIGS. 3-6 are oblique exploded views of the system of FIG. 2A.

Referring now to FIG. 3, an exploded view of the components of the system 201 are shown. The platform assembly 205 is configured to run traverse along the track formed by the frame from opposing ends. It will be appreciated that a plurality of cords are utilized to provide resistance to the movement of the lower section 305 of the platform assembly. The cords 309, 311 are configured to engage with one or more slots 303 of the frame and one or more slots 304. Likewise, additional cords could be utilized to secure to slots 302 and 300 on the opposing side.

The middle section allows for the plurality of rails of the lower section to secure to the plurality of tracks, enables rotatable attachment of the upper section to the middle section, and enables sliding movement of the middle section and upper section relative to the lower section. The middle section comprises a lower side and a middle side. The lower side comprises a plurality of bearings, a plurality of holes, and an elastic band. In the preferred embodiment, the plurality of bearings is a set of ball or plate bearings that enables rotatable support of the upper section upon the middle section, however, it is to be understood by a professional in the field of the invention that alternative embodiments, in which other means of attaching the upper section rotatably to the middle section are utilized, and the preferred embodiment is not meant to be limiting. The plurality of holes is a set of circular cuts through the lower side of the middle section, concentric with the plurality of holes of the lower section, that enable attachment of the upper surface to the middle section.

The assembly 205 is configured with an upper, middle, and lower section that provide means rotational and sliding movement of the assembly during use. The assembly further includes fasteners 331 and support members 323, 325 to retain the assembly as a unit. In one embodiment, devices 319, 321 could be positioned in one or more holes created by the upper and/or middle section of the assembly for desired control of the assembly during use and/or assistance with different Pilates stances.

The bolt is any of a variety of generally cylindrical extrusions that connects through the hole of the lower section and the middle section. The peg is a generally cylindrical extrusion generally opposite the bolt that enables a user to grasp the lower panel. The middle panel is a generally rectangular extrusion that comprises a hole, a bolt, and a peg. The hole is concentric with a hole of the plurality of holes of the lower section and a hole of the plurality of holes of the lower section that enables connection of the lower section and the middle section by the bolt. The bolt is any of a variety of generally cylindrical extrusions that connects through the hole of the lower section and the middle section. The peg is a generally cylindrical extrusion generally opposite the bolt that enables a user to grasp the middle panel.

It should be understood that the lower plurality of elastic bands is a set of connectors joining the sliding surface to the vertical grip. The lower plurality of elastic bands comprises a lower end and a middle end. The lower end attaches to the vertical grip. The middle end attaches to several of the elastic band adapters of the plurality of elastic band adapters of the sliding surface. In an alternative embodiment, the lower plurality of elastic bands may be a set of springs, hydraulic pumps, or other means of applying force to the sliding surface, and the preferred embodiment of bands is not meant to be limiting.

Figure 4:
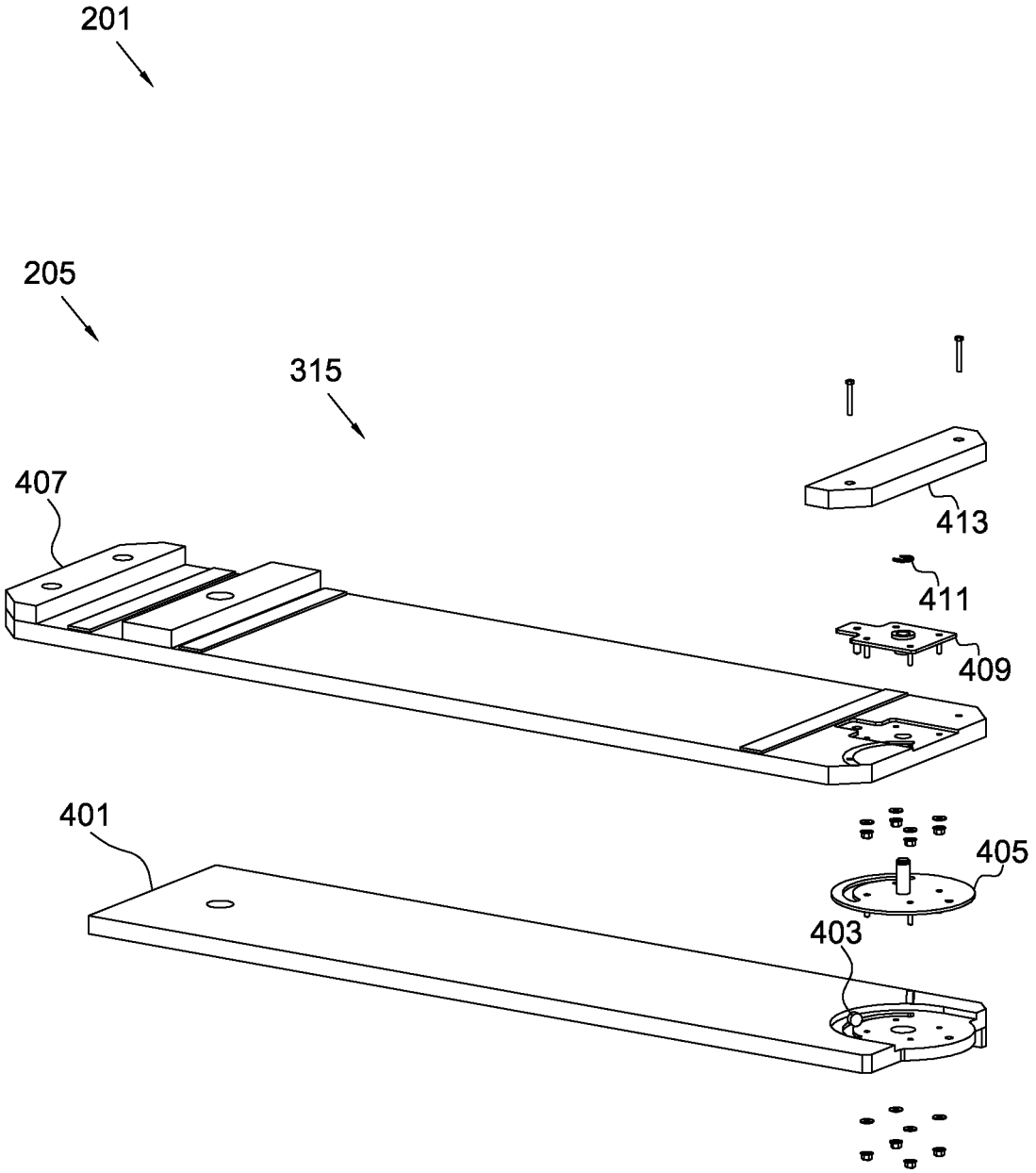

In FIG. 4, an exploded view of the upper and middles sections of the assembly are shown. It will be appreciated that the body 401 is configured to slide within the slot formed by the lower section and provides a means for rotation of the upper section with components 403, 405, 409, 411 and 413. The area 407 of the upper section provides means for the devices to secure thereto.

The middle section comprises a plurality of bearings, a plurality of holes, and an elastic band. In the preferred embodiment, the plurality of bearings is a set of ball or plate bearings that enables rotatable support of the upper section upon the middle section, however, it is to be understood by a professional in the field of the invention that alternative embodiments, in which other means of attaching the upper section rotatably to the middle section are utilized, and the preferred embodiment is not meant to be limiting. The plurality of holes is a set of circular cuts through the middle side of the middle section, concentric with the plurality of holes of the lower section, that enable attachment of the upper surface to the middle section. The elastic band is a connector that joins the middle side of the middle section to the vertical grip. In alternative embodiments, the elastic band may be a set of springs, hydraulic pumps, or other means of applying force to the sliding surface, and the preferred embodiment of bands is not meant to be limiting. In another embodiment, the middle side comprises a plurality of elastic bands, which connect to the vertical grip and to the seat.

The upper section is a surface that is generally exposed, enabling rotation and a variety of exercising options for the user. The upper surface comprises a lower panel and a middle panel. The lower panel is a generally rectangular extrusion that comprises a hole, a bolt, and a peg. The hole is concentric with a hole of the plurality of holes of the lower section and a hole of the plurality of holes of the lower section that enables connection of the lower section and the middle section by the bolt.

Figure 5:
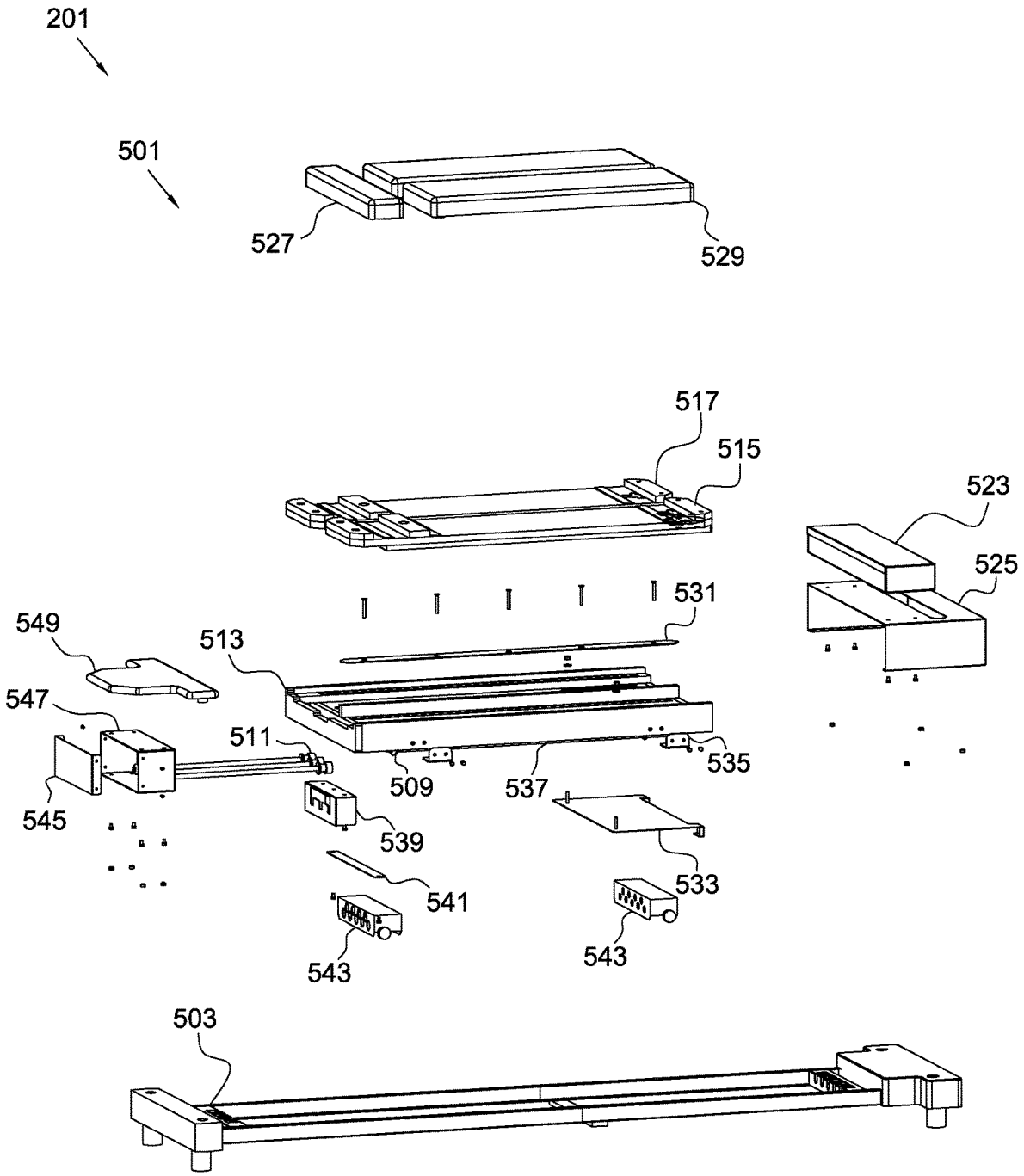
Figure 6:
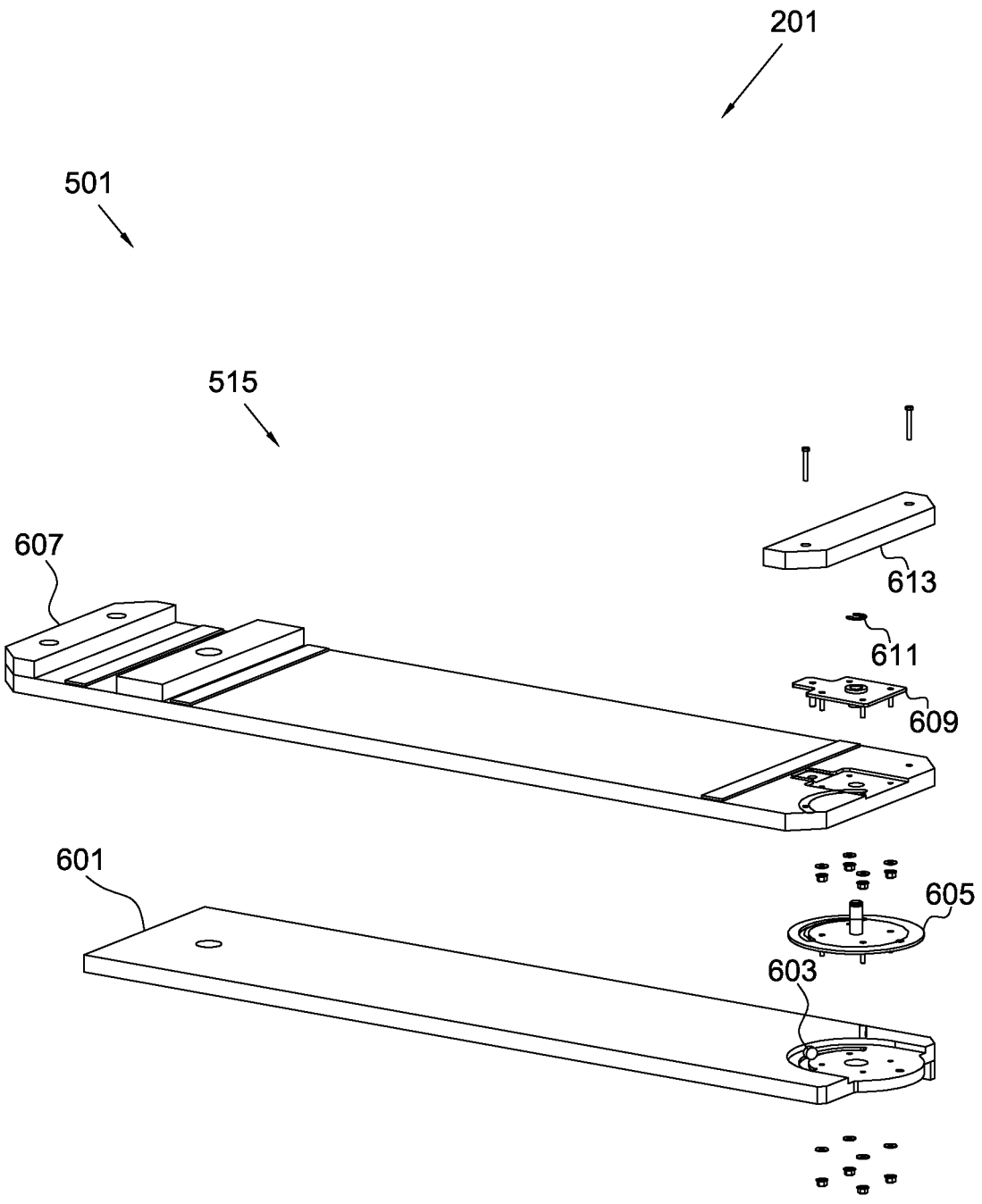

In FIGS. 5 and 6 an alternative embodiment of system 201 is shown having a frame 503 with an assembly having a lower section 512, middle sections and upper sections 515, 517 that have cushions 527 and 529 carried thereon. The system 501 also includes a plurality of rods secured to fastening members 545, 547 that are covered via a cover 549. The cords secure to members 543 and are adapted to engage with ends of the frame, as discussed above with respect to system 201. The system is further provided with a plurality of fasteners and devices as shown in the figures to secured the various components of the system together, including a plurality of structural members 533, 541, 535, 539 and 509. In FIG. 6, an exploded view of the upper and middles sections of the assembly are shown. It will be appreciated that the body 601 is configured to slide within the slot formed by the lower section and provides a means for rotation of the upper section with components 603, 605, 609, 611 and 613. The area 607 of the upper section provides means for the devices to secure thereto.

The lower section is a surface that enables support of the middle section and the upper section, and allows for the sliding surface to slide along the plurality of tracks. The lower section comprises a plurality of rails and a plurality of elastic band adapters. The plurality of rails is a series of extrusions that matches with the plurality of tracks to allow the sliding surface to slide. The plurality of rails comprises a plurality of bearings. The plurality of bearings is a set of ball or plate bearings that allows the plurality of rails to slide smoothly along the plurality of tracks.

The plurality of elastic band adapters is a set of extrusions that enables connection of the sliding surface to the lower plurality of elastic bands and the middle plurality of elastic bands, in order to provide the sliding surface with resistance for exercise. This arrangement biases the sliding surface generally towards the center of the tracks, equidistant from the seat and the vertical grip, to avoid damage due to collision of the sliding surface with the seat or the vertical grip when the user is finished exercising.

The elastic band is a connector that joins the lower side of the middle section to the vertical grip. In alternative embodiments, the elastic band may be a set of springs, hydraulic pumps, or other means of applying force to the sliding surface, and the preferred embodiment of bands is not meant to be limiting. In another embodiment, the lower side comprises a plurality of elastic bands, which connect to the vertical grip and to the seat.

The plurality of tracks is a set of tracks, generally supported beneath the sliding surface, that enable movement of the sliding surface relative to the rest of the present invention by means of the plurality of rails.

The middle plurality of elastic bands is a set of connectors joining the sliding surface to the seat. The middle plurality of elastic bands comprises a lower end and a middle end. The lower end attaches to the seat. The middle end attaches to several of the elastic band adapters of the plurality of elastic band adapters of the sliding surface. In an alternative embodiment, the middle plurality of elastic bands may be a set of springs, hydraulic pumps, or other means of applying force to the sliding surface, and the preferred embodiment of bands is not meant to be limiting.

It will be appreciated that the seat is a generally flat surface, preferably shaped ergonomically for comfort, that enables a user an intuitive position for optimal exercise. The seat comprises a plurality of handles. The plurality of handles is a set of grips that enables a user to exercise. The plurality of handles comprises a rope and a grip. The rope attaches to the seat to allow for leverage during exercise. The grip is any of a variety of handles that facilitate gripping of the plurality of handles for use during exercise.

In the preferred embodiment, the tower is a structure that provides support for the user during certain uses of the present invention. The tower is removable, enabling use with or without the tower attached. The tower comprises a lower end, a middle end, a plurality of ropes, and a plurality of supports. The lower end is a set of extrusions that joins to the plurality of ropes and the plurality of supports. The lower end extends generally perpendicular to the seat. The middle end is a set of extrusions that joins to the plurality of ropes and the plurality of supports. The middle end extends generally perpendicular to the vertical grip. The plurality of ropes is a set of ropes that extends from the lower end and the middle end, enabling a varied stimulus during certain uses of the present invention.

In one contemplated embodiment, the plurality of supports is a set of extrusions connecting the lower end to the middle end. In a preferred usage of the present invention, the user acquires a Pilates Exercise Machine. The user either places the present invention atop an existing exercise device, or places the present invention upon a flat surface. The user sits upon the seat, facing the vertical grip. The user grabs the peg of the lower panel of the upper section of the sliding surface and the peg of the middle panel of the upper section of the sliding surface. The user then pulls the lower panel and the middle panel to alternate sides of the user's body, repeating until a desired amount of time has passed. The user then releases the pegs and stands up from the seat. The present invention may be utilized in a variety of other means, and the usage described above is not meant to be limiting. The present invention is prepared for subsequent use.

In FIGS. 7-11, an exercise system 700 is shown, wherein the platform 205 as discussed above can be utilized to augment overall functionality. System 700 is an exercise system that provides a means for a plurality of exercises, some of which will be described herein. It must be appreciated that the use of system 700 is not to be limited to the exercises and examples discussed, and can be utilized in any number of ways, wherein the user stands, sits, lies down, etc. The system provides the user with diversity so that the user will be able to change out workout routines without becoming bored or stagnant in their workout.

Figure 7:
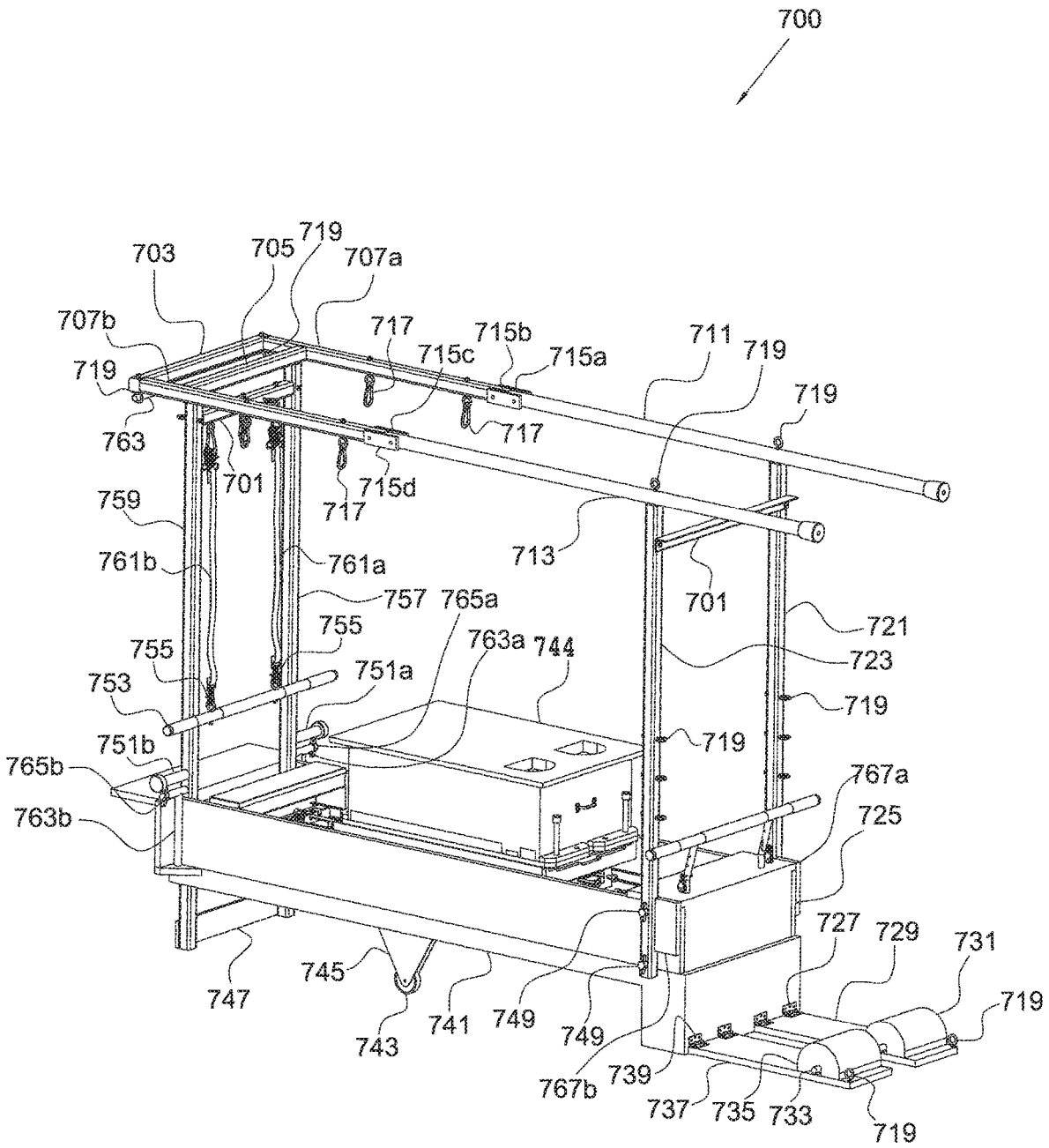
FIG. 7 is an oblique view of an exercise system in accordance with an alternative embodiment of the present invention.

Referring specifically to FIG. 7, system 700 includes framing elements 701, which are horizontal bars, rods, rails, or the like. Two end framing elements 703, 705 can be additional horizontal bars, rods, rails or the like. These horizontal framing elements provide locations for securing one or more hooks, fasteners, rings, bands, handles, and other attachment devices. In addition, these elements provide for structural integrity of the overall system.

In one embodiment, framing element 701 is pivotally connected to vertical supports 721, 723, thereby allowing for element 701 to be disengaged and pivot downward to remove it from obstructing the user during use. This can easily be achieved via any release, such as the use of a screw and a cutout in element 701 to engage with the screw.

System 700 further includes top frame 707, which is connected to frame elements 703, 705. This provides for a frame portion that remains extended and connected during use.

The framing elements can vary in size and material as manufacturing or functional considerations require. The framing elements are positioned above a base 741, which allows for the use of system 700 for various exercises wherein the user is reaching upward, or utilizing elements above them for support.

In the preferred embodiment, two poles 711, 713 are pivotally engaged with framing elements 707 via hinges 715, thereby allowing for the poles to be dropped downward and used in alternative exercises. This is better shown in FIGS. 10 and 11, wherein the dropping down of the poles provides for opening up of the system, and also alternate positioning of the poles for user support. The poles and framing elements can include various attachment devices 717, 719, such as clips, rings, hooks, and the like, to provide places for the user to engage exercise elements, straps, handles, harnesses, and the like in a number of different positions to facilitate innumerous exercises.

In the preferred embodiment, a bar 763 can be positioned to extend between frame elements 707, which can again provide for a plurality of attachment locations and functionality as needed.

In the preferred embodiment, two vertical members 721, 723 are positioned at a forward location, wherein the vertical members include additional attachment devices 719, such as hooks, rings or the like. in the preferred embodiment, the two vertical members 721, 723 are removable via pins 749, thereby again allowing for the system to open up for use in alternative configurations. It should also be understood that poles 711, 713 are not permanently affixed to the vertical members 721, 723.

System 700 further includes a removable leg press element, which is configured to engage with an end 725 of base 741, wherein the leg press element can include hinges 727, 739, that can allow for the leg extension components 729, 737 to be positioned at various angles. The leg extension components 729, 737 can be secured to attachment devices 719, via cables, ropes, bungees, or the like to hold the extensions at a desired angle. One or more pads 731, 735 can be secured to a removable rod 733 for comfort during use. During use, these extensions can be used for leg press movement, arm press movement, general support, or any other means. In addition, the leg press element can be fully removable from system 700.

As further shown, system 700 includes a base 741 with supports 767 and braces 747, legs 745, wheels 743, and the like. The base 741 can include a box 744, which can be used by the user as a place to sit, stand, or lie during exercises. The box 744 can be a structure without any padding, and can include a textured surface, which allows for the user to stand or sit securely. The base can be engaged with a track, as described above, to allow for the platform to traverse within the base, thereby facilitating movement, exercise, stretching, and the like.

Many alternative embodiments of the platform could be utilized, wherein the platform could include openings, handles, padding, and the like.

The base 741 is further engaged with vertical members 757, 759, wherein the base can be adjusted via an adjustment devices 751*a-b*. This allows for the user to adjust an angle associated with the base. In addition, system 700 includes supports 763 and pins 765 for adjustment of the base 741 relative to vertical members 757, 759.

In FIG. 7, the system is shown to include one or more pulleys 761 engaged with a bar 753 via one or more clasps 755, which allows for pull down style exercise by the user. It should be appreciated that this particular use is merely one example of the number of ways in which elements can be attached to system 700.

Figure 8:
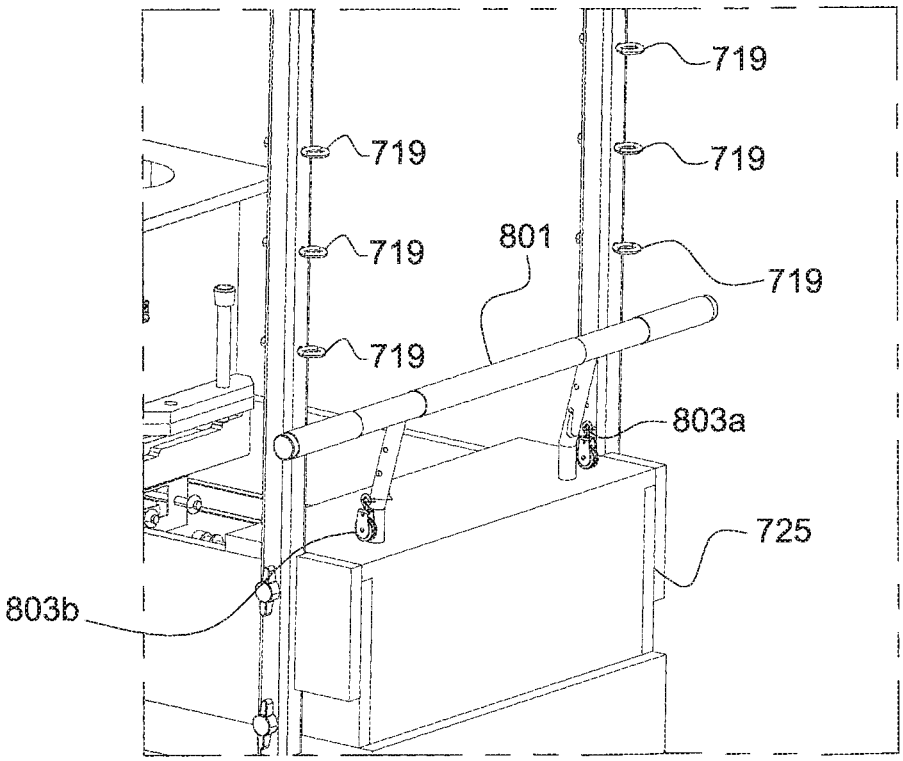
FIG. 8 is a close up of a bar attachment of FIG. 7.

In FIG. 8, a bar attachment is shown, wherein a bar 801 can be adjustably attached to end 725 and can include one or more pulley attachments 803. The bar can provide a means for the user to engage in a plurality of exercises, and can support the user as needed. It should also be appreciated that the bar can be adjusted in height as needed to fit the user.

Figure 9:
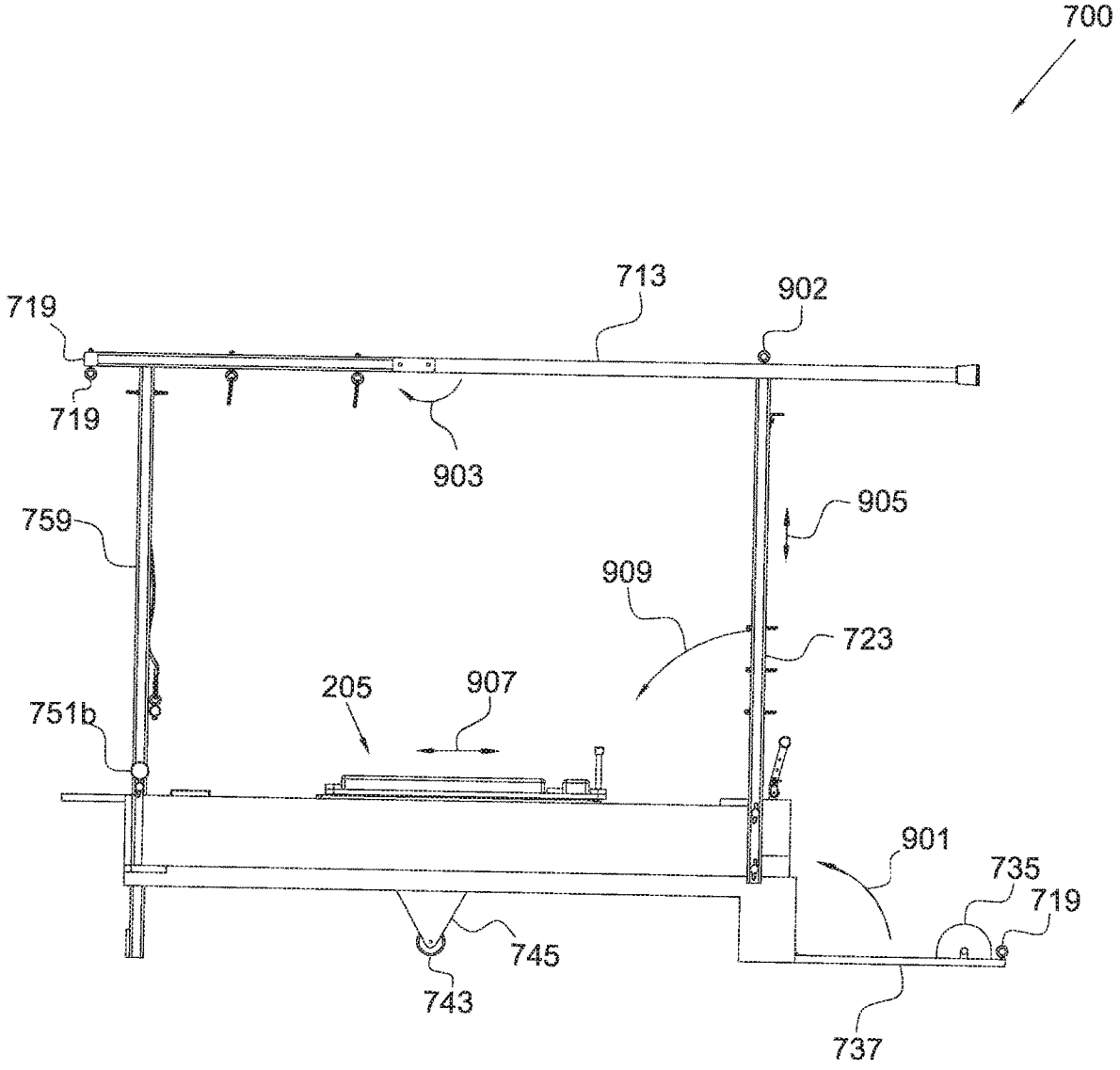
FIG. 9 is a side view of the system of FIG. 7.
Figure 10:
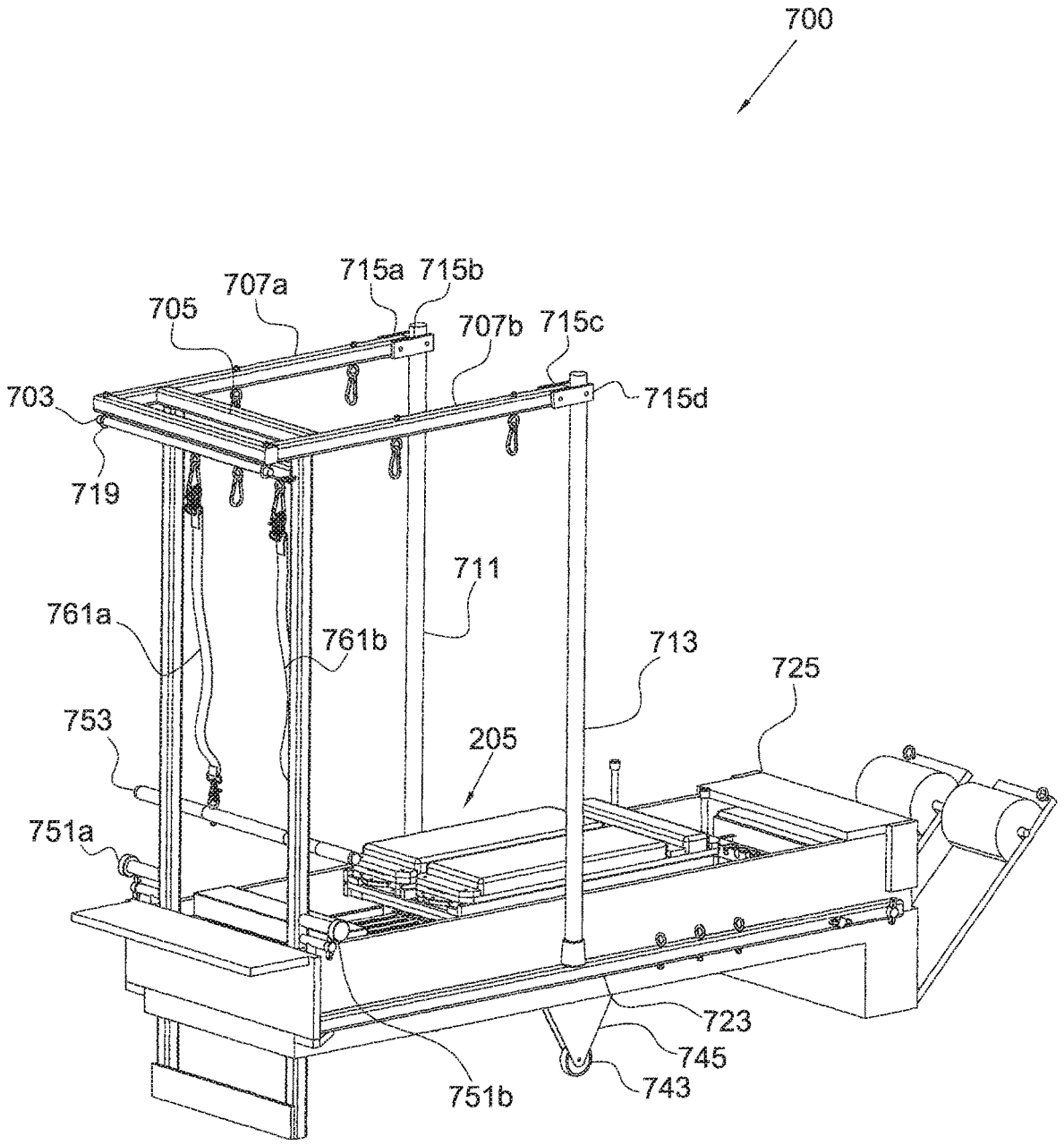
FIGS. 10 and 11 are oblique views of the system of FIG. 7 in an alternate configuration.
Figure 11:
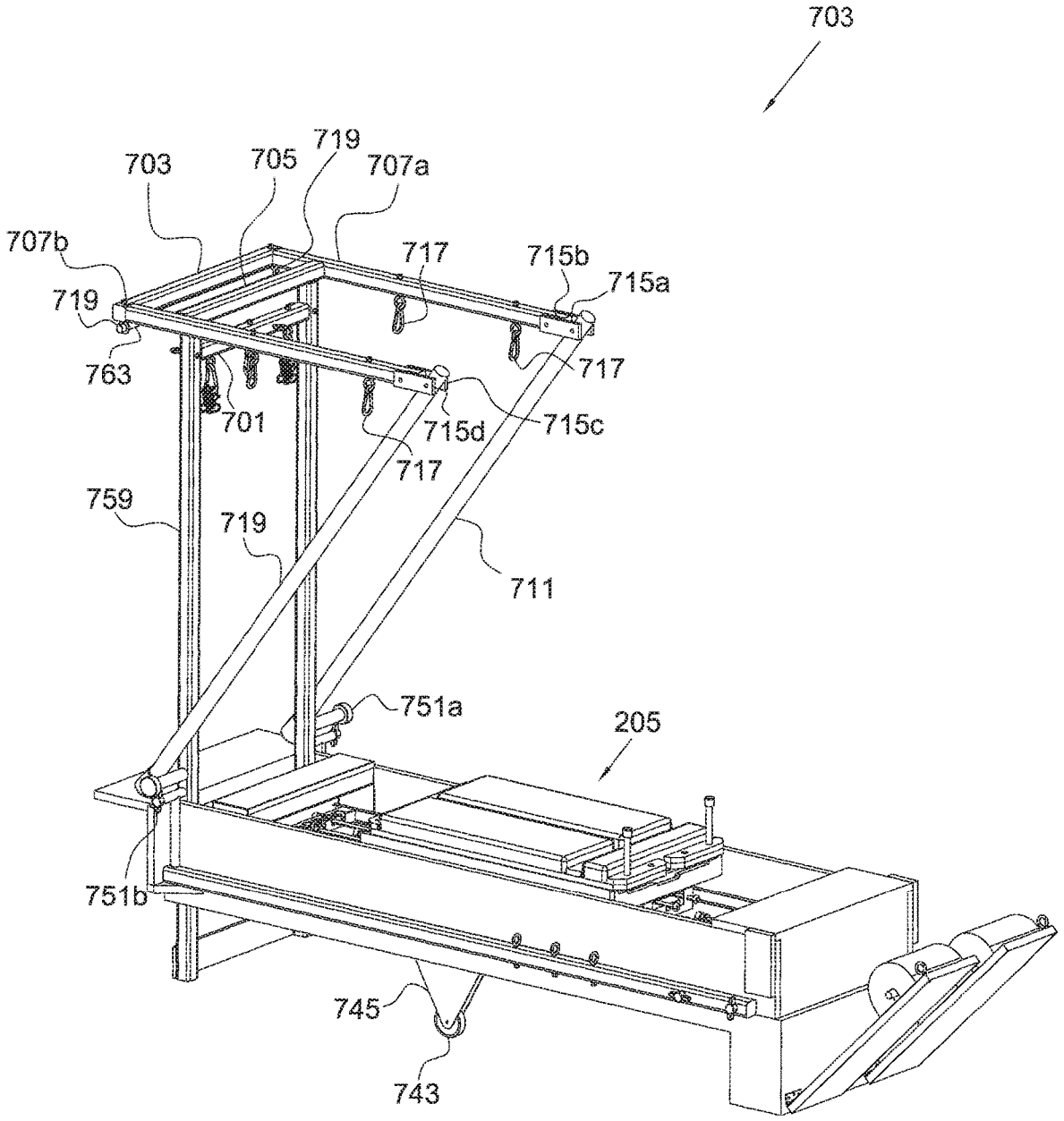

In FIG. 9, a side view depicts system 700 for clarity, wherein the leg press pivotally 901 engages with the base, and pole 713 is shown able to pivot 903 relative to the frame. In addition, it should be appreciated that the vertical members 723 can also pivot downward 909. The vertical member 723 and pole 713 can secure together via an attachment device 903 to provide stability. In FIGS. 10 and 11, system 701 is shown wherein the poles 711, 713 are pivoted away from their horizontal position, thereby providing for alternate uses of system 701. In some embodiments, the poles are secured at an angle, which allows for user support while the user engages with platform 205. Vertical elements 721, 723 can be dropped into a completely horizontal position for unobstructed use of system 701.

It should be appreciated that platform 205 as described above can be housed within base 741, which provides for a moving platform 907 that includes one or more cushions. The user can utilize platform 205 in any of the means described above as a way to exercise.

By way of example, the user can stand on platform 205 and proceed to stretch, lean, lunge, squat or the like. The user can utilize the various structural components for grasping and support. Further, bungees, harnesses, grips, or the like can be engaged with the various attachment sites, thereby providing elements for the user to grasp and support themselves, or lean, bend, stretch, or the like.

Figure 12:
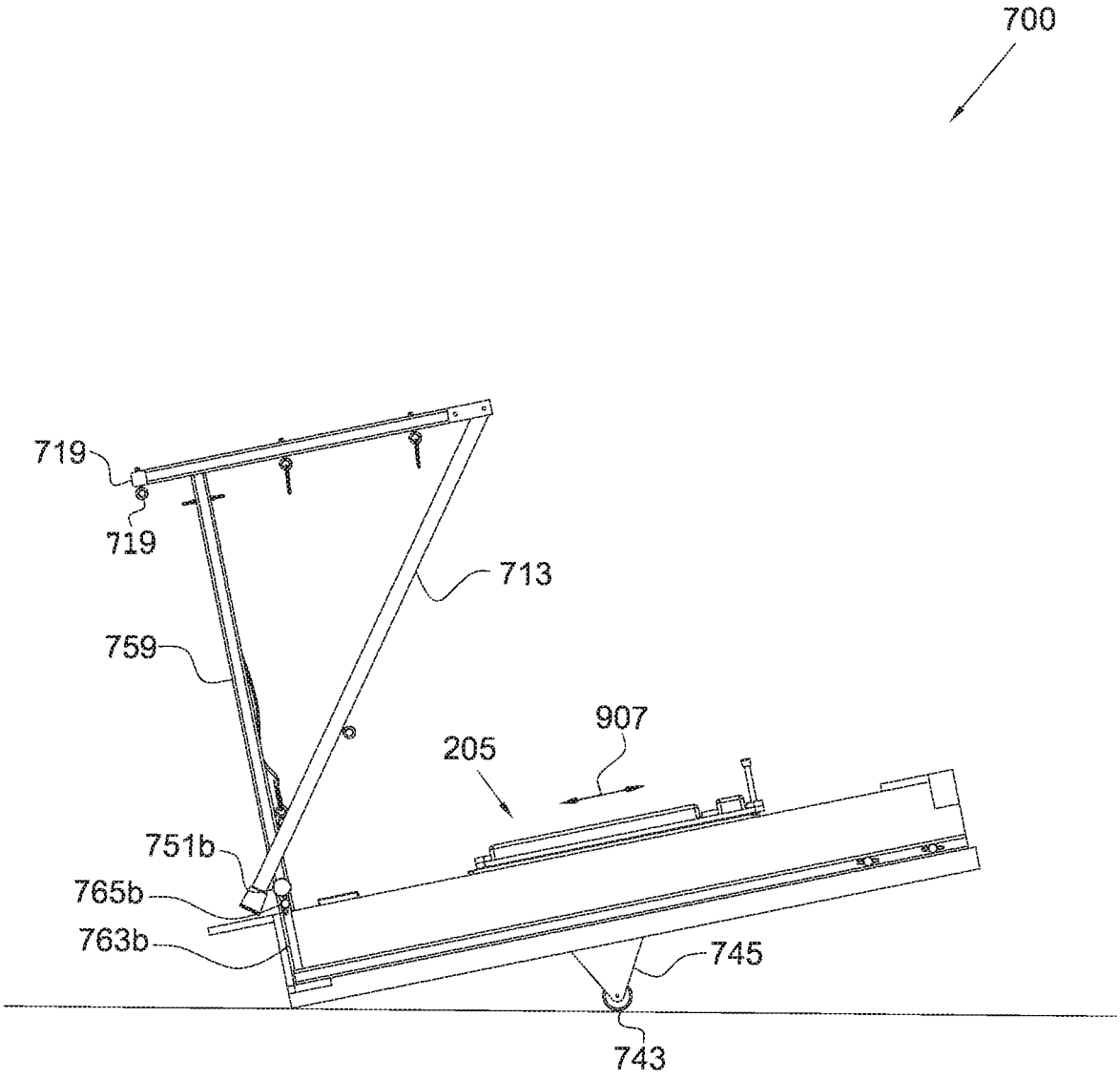
FIG. 12 is an oblique view of the system of FIG. 7 in an alternative configuration.

In FIG. 12, system 700 is shown at an angle, wherein the system 700 can easily be transported via wheel 743.

The particular embodiments disclosed above are illustrative only, as the embodiments may be modified and practiced in different but equivalent manners apparent to those skilled in the art having the benefit of the teachings herein.

It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A Pilates exercise system, comprising:

a pair of forward vertical members and a pair of rear vertical members extending upward from a base;

a frame positioned at a top of the vertical members, the frame having:

one or more poles pivotally engaged with one or more framing members;

the one or more poles configured to pivot from a horizontal to a vertical position;

a platform assembly slidingly housed within the base, the platform assembly is configured to slide on a first track and a second track, the platform assembly, having:

a lower section configured to engage with the first track and the second track;

a middle section slidingly engaged with the lower section; and an upper section pivotally attached to the middle section; and a plurality of attachment elements secured to the vertical members and configured to provide locations for attachment of exercise equipment.

2. The system of claim 1, further comprising:

one or more attachment devices secured to the one or more poles.

3. The system of claim 2, wherein the one or more attachment devices are rings.

4. The system of claim 1, wherein the pair of forward vertical members are engaged with the base via one or more removable pins, thereby allowing for removability of the pair of forward vertical members.

5. The system of claim 1, further comprising:

a leg press removably attached to an end of the base.

6. The system of claim 5, wherein the leg press further comprises:

a first leg extension component secured to the end via a first hinge; and a second leg extension component secured to the end via a second hinge.

7. The system of claim 6, wherein the leg press further comprises:

a first pad attached to the first leg extension component;

a second pad attached to the second leg extension component; and a rod removably extending between the first pad and the second pad.

8. The system of claim 1, further comprising:

a bar attached to an end of the base.

9. The system of claim 1, further comprising:

a wheel extending from a bottom of the base.

* * * * *